US009663291B1

(12) United States Patent
Sanger

(10) Patent No.: US 9,663,291 B1
(45) Date of Patent: May 30, 2017

(54) SHIPPING CONTAINER HAVING DRAWERS WITH LOCKABLE LATCH ASSEMBLIES

(71) Applicant: Bradford Company, Holland, MI (US)

(72) Inventor: Matthew S. Sanger, West Olive, MI (US)

(73) Assignee: Bradford Company, Holland, MN (US)

( * ) Notice: Subject to any disclaimer, the term of this patent is extended or adjusted under 35 U.S.C. 154(b) by 28 days.

(21) Appl. No.: 14/944,856

(22) Filed: Nov. 18, 2015

(51) Int. Cl.

| | |
|---|---|
| ***A47B 88/04*** | (2006.01) |
| ***B65D 88/54*** | (2006.01) |
| ***A47B 88/16*** | (2006.01) |
| ***A47B 88/20*** | (2006.01) |
| *A47B 95/02* | (2006.01) |

(52) U.S. Cl.
CPC ..... *B65D 88/546* (2013.01); *A47B 88/16* (2013.01); *A47B 88/20* (2013.01); *A47B 2095/024* (2013.01); *A47B 2210/0037* (2013.01)

(58) Field of Classification Search
CPC ..... B65D 88/546; A47B 88/57; A47B 88/50; A47B 88/40; A47B 88/90
USPC ..... 312/216, 218, 333
See application file for complete search history.

(56) References Cited

U.S. PATENT DOCUMENTS

| | | | | |
|---|---|---|---|---|
| 1,353,453 | A * | 9/1920 | Chipperfield | E05B 65/462 312/218 |
| 2,729,498 | A * | 1/1956 | Law | B60P 3/007 211/126.15 |
| 2,750,901 | A * | 6/1956 | McClellan | A47B 63/00 109/59 R |
| 9,004,307 | B2 | 4/2015 | Bradford et al. | |
| 9,010,563 | B2 | 4/2015 | Bradford et al. | |
| 9,016,507 | B2 | 4/2015 | Bradford et al. | |
| 2008/0078729 | A1* | 4/2008 | Bazany | A47F 5/0093 211/59.2 |

* cited by examiner

*Primary Examiner* — Stephen Castellano
(74) *Attorney, Agent, or Firm* — Wood, Herron & Evans, LLP

(57) ABSTRACT

A container for holding product therein during shipment and being returned for reuse has a base and two sides, tracks attached to opposite sides, and a plurality of drawers. Each drawer has at least one drawer support which moves along the tracks during movement of the drawer. Rotatable members at the front of the container assist movement of the drawers. Each drawer has a latch assembly for locking the drawer in a closed position during shipment. Dunnage may be located inside one or more of the drawers.

20 Claims, 14 Drawing Sheets

SHIPPING CONTAINER HAVING DRAWERS WITH LOCKABLE LATCH ASSEMBLIES

FIELD OF THE INVENTION

The present invention relates to containers for use in shipping and, more particularly, to containers with movable drawers for shipping product.

BACKGROUND OF THE INVENTION

A large number of different container structures are utilized by manufacturers to ship a variety of different products to end users which may be, for example, assembly plants. In the automobile industry, for example, an assembly plant assembling a particular automobile might utilize a number of different parts from different manufacturers. These manufacturers ship their respective parts to the assembly plant in containers in which the parts are then removed from dunnage hanging from movable dunnage supports inside the container and assembled into a finished automobile.

Access to the product in the containers is of particular concern. Specifically, in the automotive industry, the containers full of product are positioned on an assembly line adjacent to a work area which is associated with a particular product to be installed on a manufactured vehicle. For example, a container full of parts is usually positioned next to a particular station on an assembly line where the parts are installed so that a line worker may easily access the parts inside the container. The product or part is taken directly from the container and used on the line. Some existing containers are difficult to access, which makes removal of the parts therein difficult and time consuming. For example, some containers are configured so that a line worker must walk around the container to remove parts or products from opposite ends of the container. As may be appreciated, a line worker only has a certain amount of time to install a part. Any delay in access and removal of the part from the container is undesirable.

In many containers, a line worker or employee must insert or remove parts from a distal or rear part of the container. The size and/or weight of the parts or work pieces may cause stress or strain on the line worker and, more particularly, on the back of the worker when inserting or removing parts from such a container. Such ergonomically unfriendly movements may cause physical trauma, pain and other injuries that may lead to lost production time.

In some situations, in order to alleviate such stress and/or strain on his or her body, the line worker may move to the rear or opposite end of the container to remove parts from inside the container. This requires space around the container which may not be available, depending on the physical layout of the plant or facility. The length (front to back) of certain containers may be limited because the container manufacturer needs to eliminate the need for a line worker to walk around the container to remove product from inside the container. Such containers having a reduced length reduce the number of parts or products which may be shipped and/or stored in the container. The more containers needed to ship a predetermined number of parts, the greater the cost to the shipper.

In some containers having multiple layers or level of parts, a line worker or employee must lean forward and bend down into the container to insert or remove a part or work piece from the bottom of the container. This movement by the line worker is ergonomically unfriendly because the line worker must lean forward and bend down into the container to insert or remove a part or work piece from the bottom of the container.

Depending upon the number of times the line worker repeats this unnatural motion, strain in the back, legs and arms may result. The size and/or weight of the parts or work pieces may increase the strain on the line worker. Thus, simply removing multiple parts during a work day may cause physical trauma, pain and other injuries that may lead to lost production time. Consequently, returnable and reusable containers having multiple levels of movable dunnage have been used.

In known containers having multiple levels or layers of dunnage, such as pouches, products are inserted into pouches suspended by dunnage supports. The dunnage supports may have end members at opposed ends thereof adapted to move in tracks secured to the sides of the container. Alternatively, the dunnage supports may be unitary members with end portions movable along tracks.

One issue with inserting products into hanging dunnage, such as pouches, is that the products may contact the material of the pouch more than desired during the loading or unloading processes. Such contact may damage one or more of the products being shipped.

Accordingly, there is a need for a returnable and reusable shipping container which has one or more layers of movable dunnage which reduce or avoid contact between the product to be shipped and the dunnage.

There is further a need for a returnable and reusable shipping container having multiple levels of dunnage inside movable drawers.

SUMMARY OF THE INVENTION

The present invention provides a container for holding product therein during shipment that has a body having a base and at least two sides. The container further comprises at least one set of tracks supported by the container sides. The container may have any number of vertically spaced levels or layers of tracks. One embodiment utilizes tracks, each comprising a back and walls extending outwardly from the back. However, the tracks may assume other configurations. The container further comprises rods extending between the sides of the container. Each of the rods may be surrounded by a roller to facilitate opening or closing a drawer of the container.

The container further comprises drawers extending between tracks on opposed sides of the container. Each of the drawers is movable between an open position and a closed position. Each of the drawers has at least one drawer support movable along the tracks during movement of the drawer. Each of the drawers has a latch assembly, including a handle and locking mechanisms. In one embodiment, the handle is an integral part of the latch assembly. However, it is within the present invention that the handle be separate from the latch assembly. Each of drawers is held in its closed position by the locking mechanisms. Each of the drawers may only be moved to its open position by moving the handle and causing portions of the latch assembly to disengage from one of the rods.

One or more of the drawers may be made of any known plastic material, including corrugated plastic. One or more of the rollers may be made of plastic, such as polyvinylchloride, known as PVC. The rods may be made of wood, metal or any other suitable material.

The container may further comprise dunnage secured in one or more of the drawers. The dunnage may comprise dividers or any other known form of dunnage for holding parts or products during shipment and storage so the parts inside the drawers do not become damaged during shipment. The dunnage may be secured inside the drawers in any known manner and may be removable from the drawer. The dunnage is not intended to be limited to the dunnage shown in the drawings. For example, an intersecting partition assembly made of Softedge® material may be located inside one or more of the drawers. The dunnage may be made of foam or any other known material and may be slotted and/or shaped so as to prevent parts in the same drawer from contacting and damaging each other during shipment.

According to another aspect of the invention, the container for holding product therein during shipment has a base and at least two sides. The container comprises multiple sets of tracks supported by opposed container sides. In one embodiment, each of the tracks comprises a back and walls extending outwardly from the back. Roller assemblies extend between the sides of the container. Each roller assembly comprises a rod surrounded by a rotatable roller which may be made of any desired plastic material.

The container further comprises a plurality of drawers. Each of the drawers is movable between open and closed positions and has at least one drawer support movable along the tracks during movement of the drawer. Each of the drawers has a latch assembly which biases the drawer in its closed position. The drawer may only be moved to its open position by moving a handle of the latch assembly, thereby causing a portion of the latch assembly to disengage from one of the roller assemblies.

The container may further comprise foam dunnage inside one or more of the drawers or any other known form of dunnage. The dunnage may be secured inside the drawer in any desired known manner.

According to another aspect of the invention, the container for holding product therein during shipment has a base and at least two sides. The container further comprises braces secured to each of the sides. Vertically spaced sets of tracks are secured to each of the braces. In one embodiment, each of the tracks has a back and walls extending outwardly from the back. Stationary rods extend between the sides of the containers. Each of the rods may be partially surrounded by a rotatable roller, such as a tube made of any desired plastic material to facilitate movement of the drawers.

The container further comprises a plurality of drawers, each of the drawers being movable between a closed position inside the container and an open position in which products may be inserted into or removed from inside the drawer. Each drawer has at least one drawer support movable along the tracks during movement of the drawer. Each of the drawers also has a spring-loaded latch assembly which holds the drawer in its closed position until a portion of the latch assembly is raised to allow the drawer to disengage from one of the rods and be moved to its open position. Using one type of track, each drawer support may remain inside the tracks during movement of the drawer. In one embodiment, each of the drawers is made of corrugated plastic, thereby reducing the weight of the container. The lightweight drawers enable an operator to quickly and easily open and close the drawers to insert products into the drawer one drawer at a time, or remove products from the drawers one drawer at a time.

The above and other objects and advantages of the present invention shall be made apparent from the accompanying drawings and the brief description thereof.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION OF THE INVENTION

Figure 1:
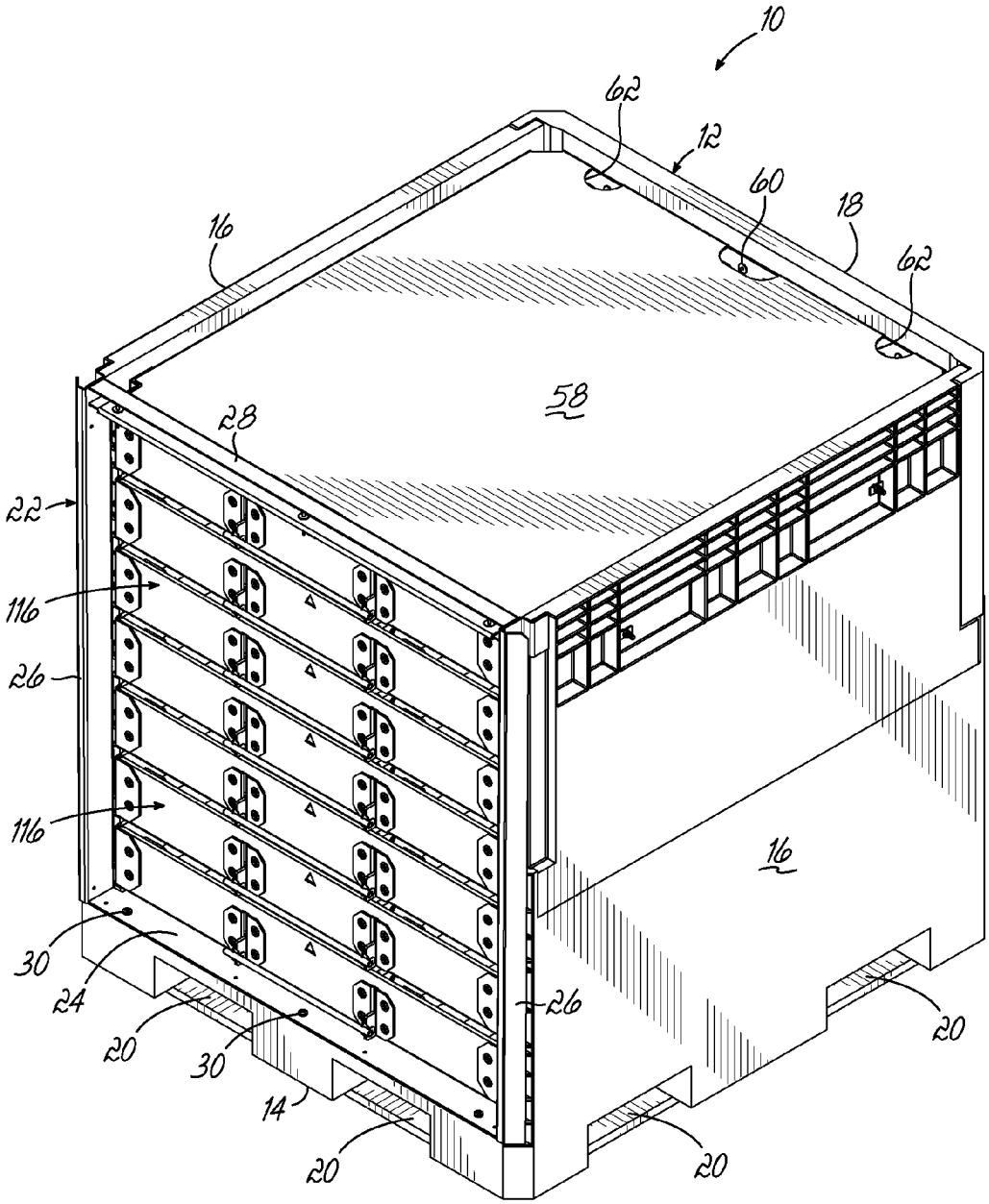
FIG. 1 is a perspective view of a portion of one embodiment of a reusable and returnable container showing seven layers of drawers.

Referring to FIG. 1, there is illustrated a reusable and returnable container 10. The container 10 comprises a body 12 having a base 14, opposed sides or side walls 16 and a rear or rear wall 18, all extending upwardly from base 14. The base 14 has passages 20 adapted to receive and retain prongs of a forklift to move the container 10 with a vehicle. Although one type of container is illustrated, the present invention may be used with any type or configuration of container. For example, the present invention may be used in a container in which one or more of the sides of the container are hinged for the container to be more easily erected and/or compacted for storage. The container may also be a rack type of container which has four corner posts extending upwardly from a base. For purposes of this document, any of the structures 16 or 18 may be considered side structures or sides or walls.

Figure 2:
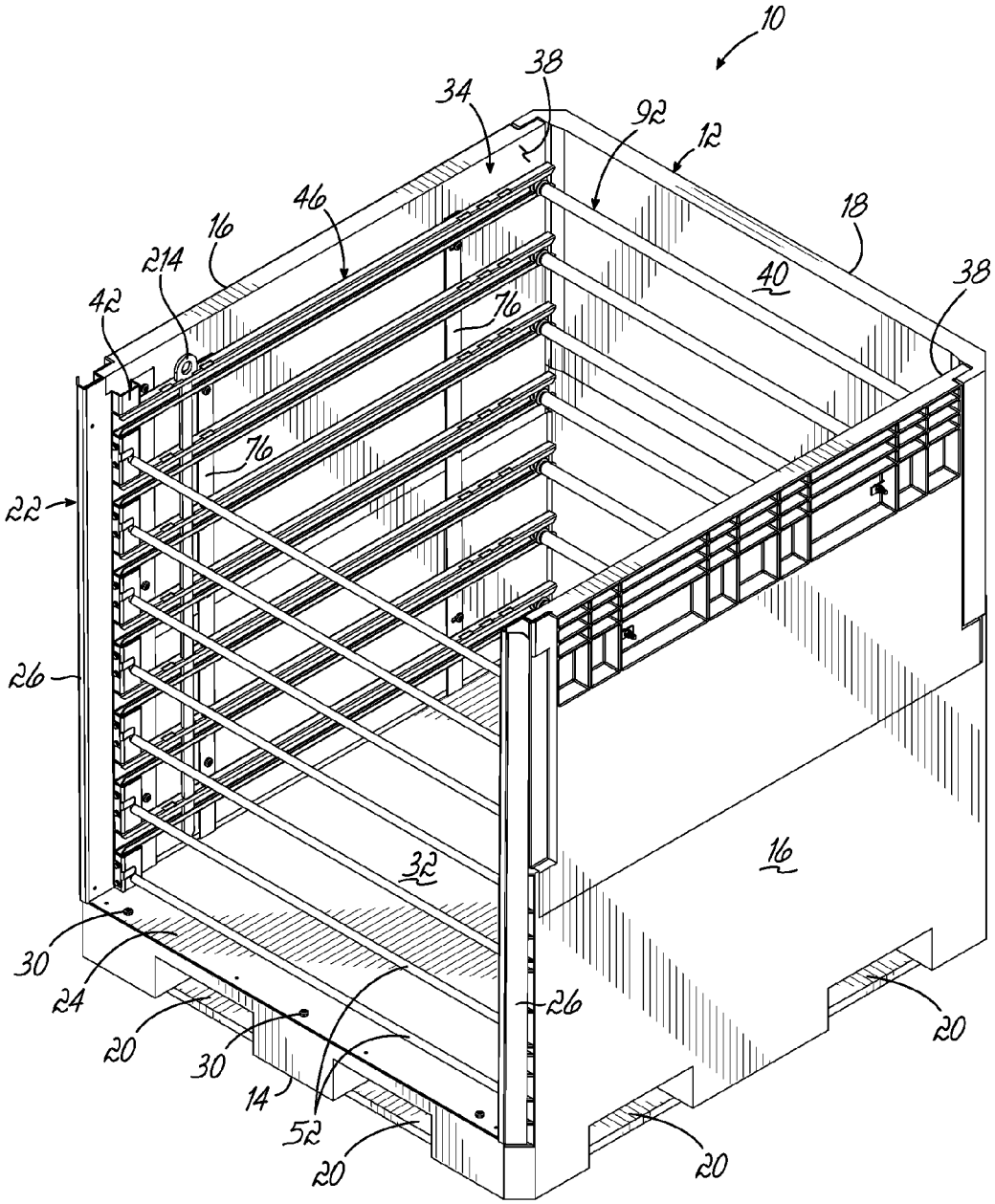
FIG. 2 is a perspective view of a portion of the container of FIG. 1.
Figure 2A:
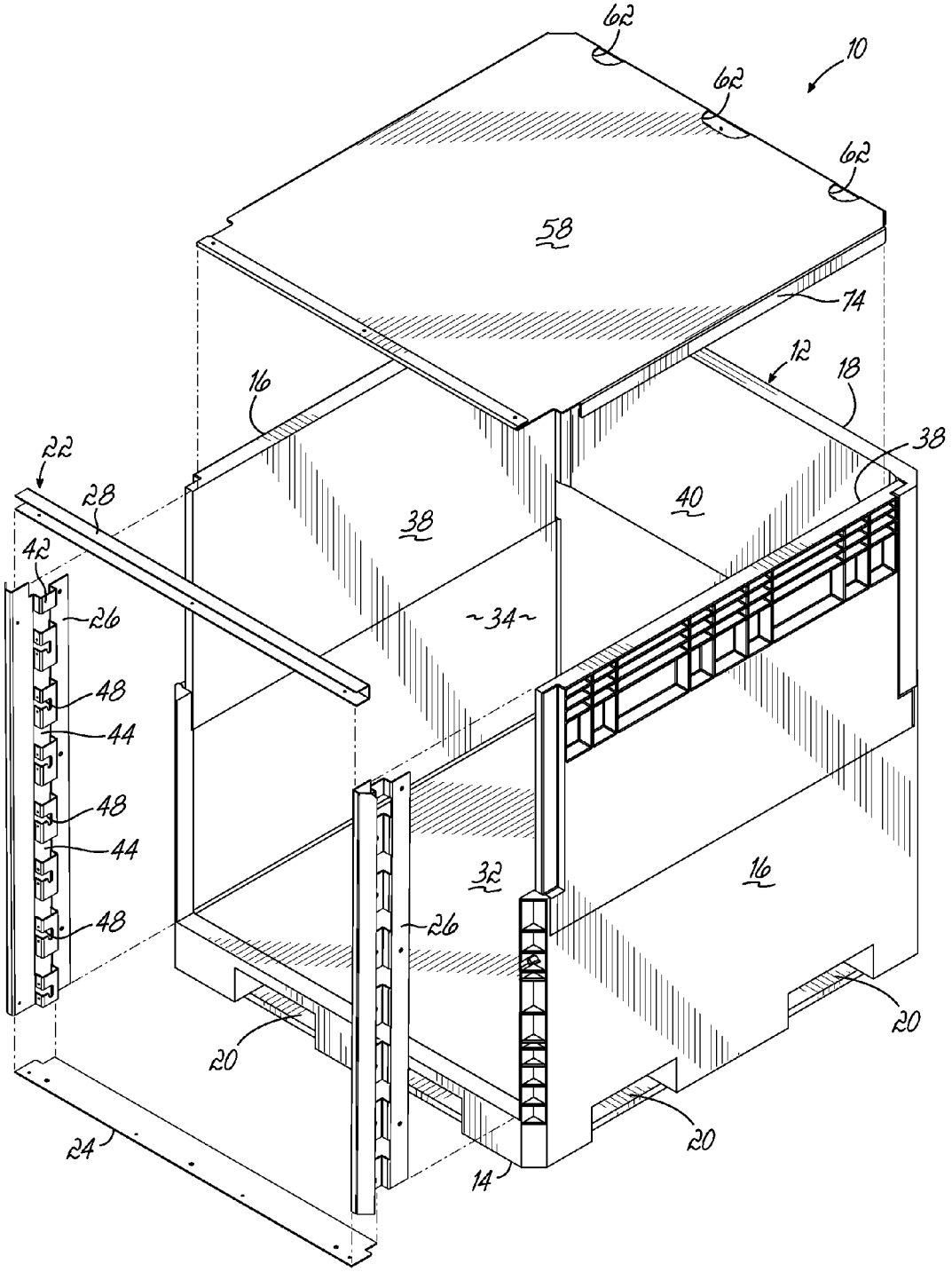
FIG. 2A is a partially disassembled perspective view of a portion of the container of FIG. 1.

As shown in FIG. 2A, the container 10 further comprises a front frame 22 comprising four pieces: a stability plate 24, two side members 26 and a top channel 28. The front frame members are typically made of metal, but may be made of any suitable material. The stability plate 24 is secured with fasteners to an upper surface 32 of base 14, which is also the floor of the container's interior by fasteners 30. The container's interior 34 is defined by the upper surface 32 of base 14, interior surfaces 38 of opposed side walls 16 and interior surface 40 of rear wall 18. Each side member 26 of the front frame 22 is secured to one of the side walls 16 with fasteners 36, one being shown in FIG. 3. The top channel 28 extends between the tops of the side members 26 of the front frame 22 and is secured to each of the side walls 16.

Figures 3, 3A:
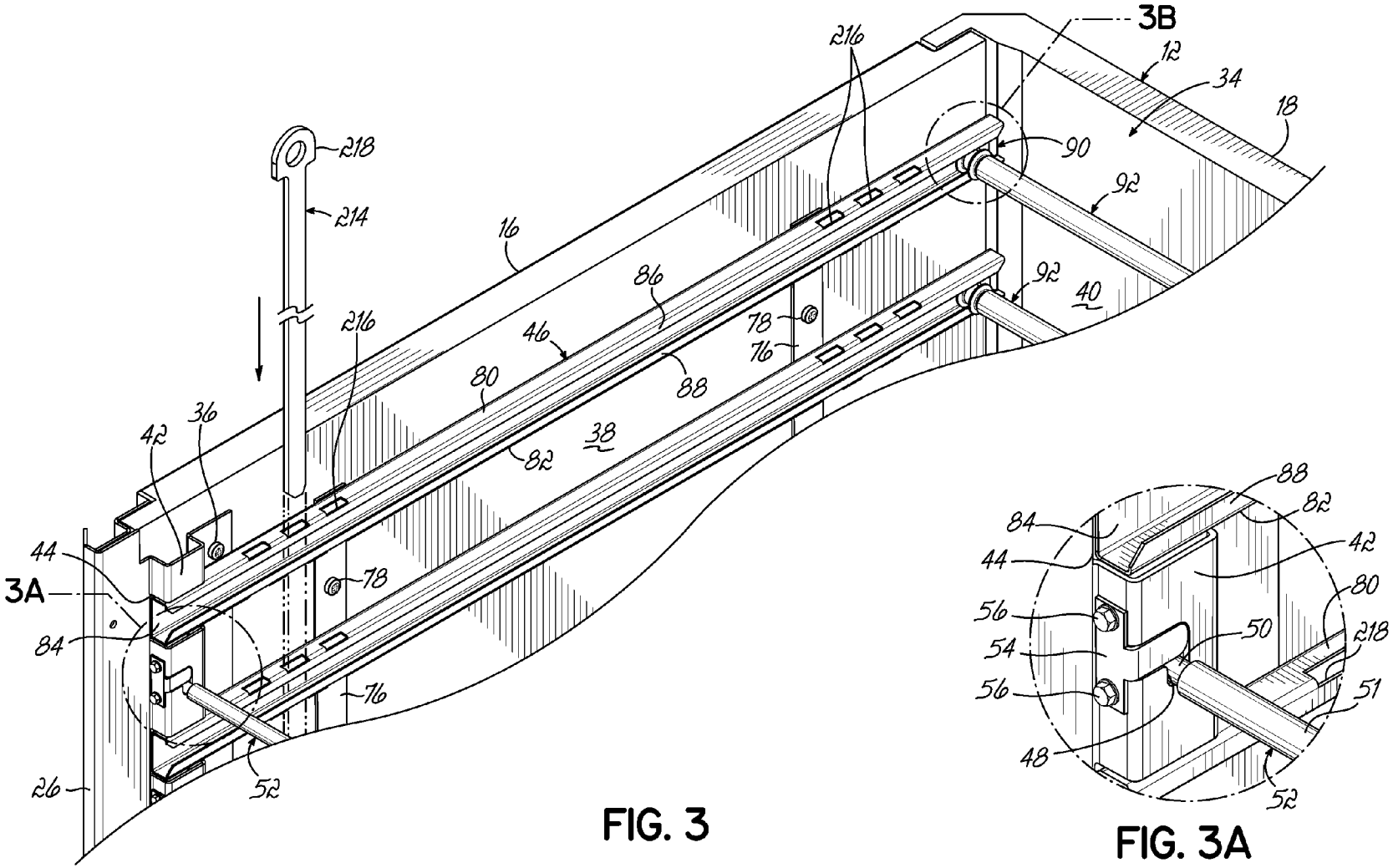
FIG. 3 is an enlarged perspective view of a portion of the container of FIG. 1 showing a stop being inserted through tracks inside the container.
FIG. 3A is an enlarged perspective view of the encircled area 3A of FIG. 3.
Figure 5:
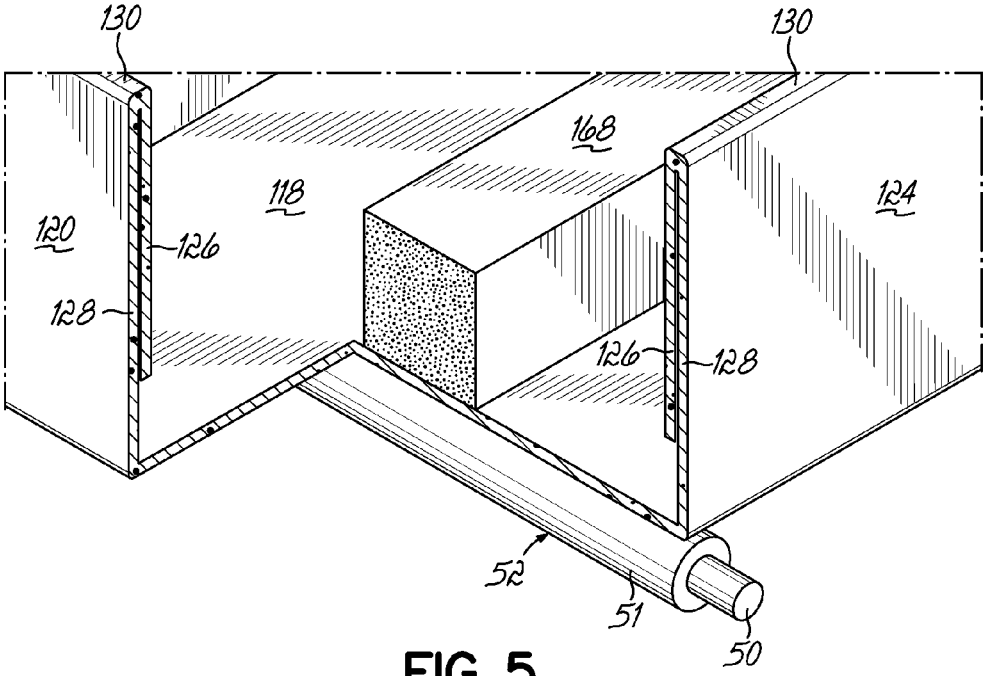
FIG. 5 is a cross-sectional view taken along the line 5-5 of FIG. 4.

As best illustrated in FIGS. 3 and 3A, each of the side members 26 of the front frame 22 has a longitudinally extending generally U-shaped channel 42 having a plurality of cut-outs 44. Each of the cut-outs 44 is sized and adapted to receive one of the tracks 46, as described below. As best illustrated in FIG. 3A, the channel 42 of each side member 26 has a plurality of slots 48 vertically spaced from one another. Each slot 48 allows an end of one of the rods 50 of one of the roller assemblies 52 to be inserted or removed from the side member 26. As shown in FIG. 5, each roller assembly 52 comprises a roller 51 surrounding a rod 50. Each slot 48 is covered by a cover plate 54 using fasteners 56. By removing cover plates 54 of the two side members 26 at the same level or layer, an operator may remove one of the roller assemblies 52 for repair/replacement.

Figure 8A:
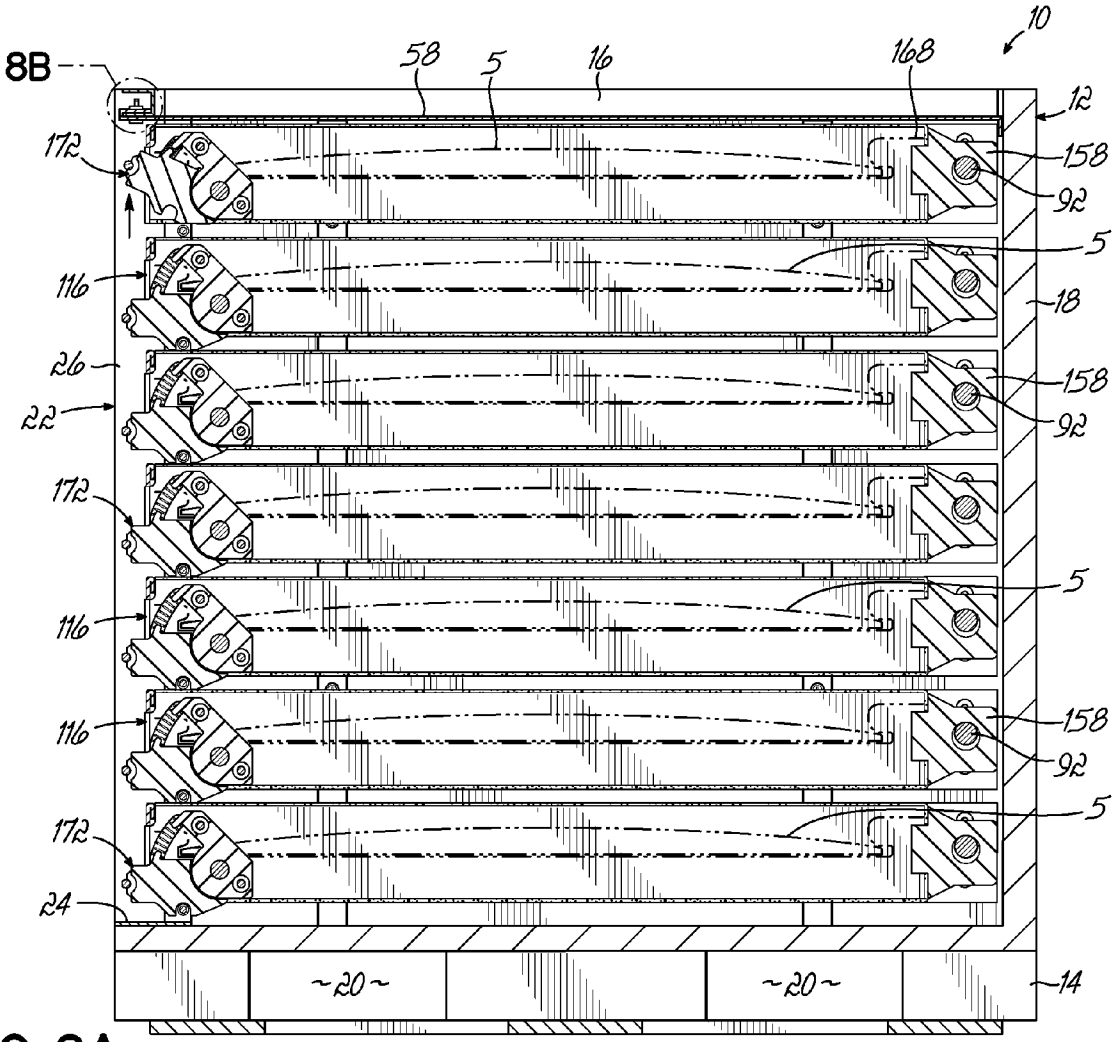
FIG. 8A is a side elevational view of the container of FIG. 1 loaded with products shown in dashed lines.
Figure 8B:
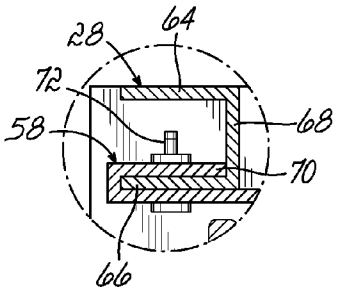
FIG. 8B is an enlarged view of the encircled area 8B of FIG. 8A, showing the cover being attached to a portion of the front frame.
Figure 8C:
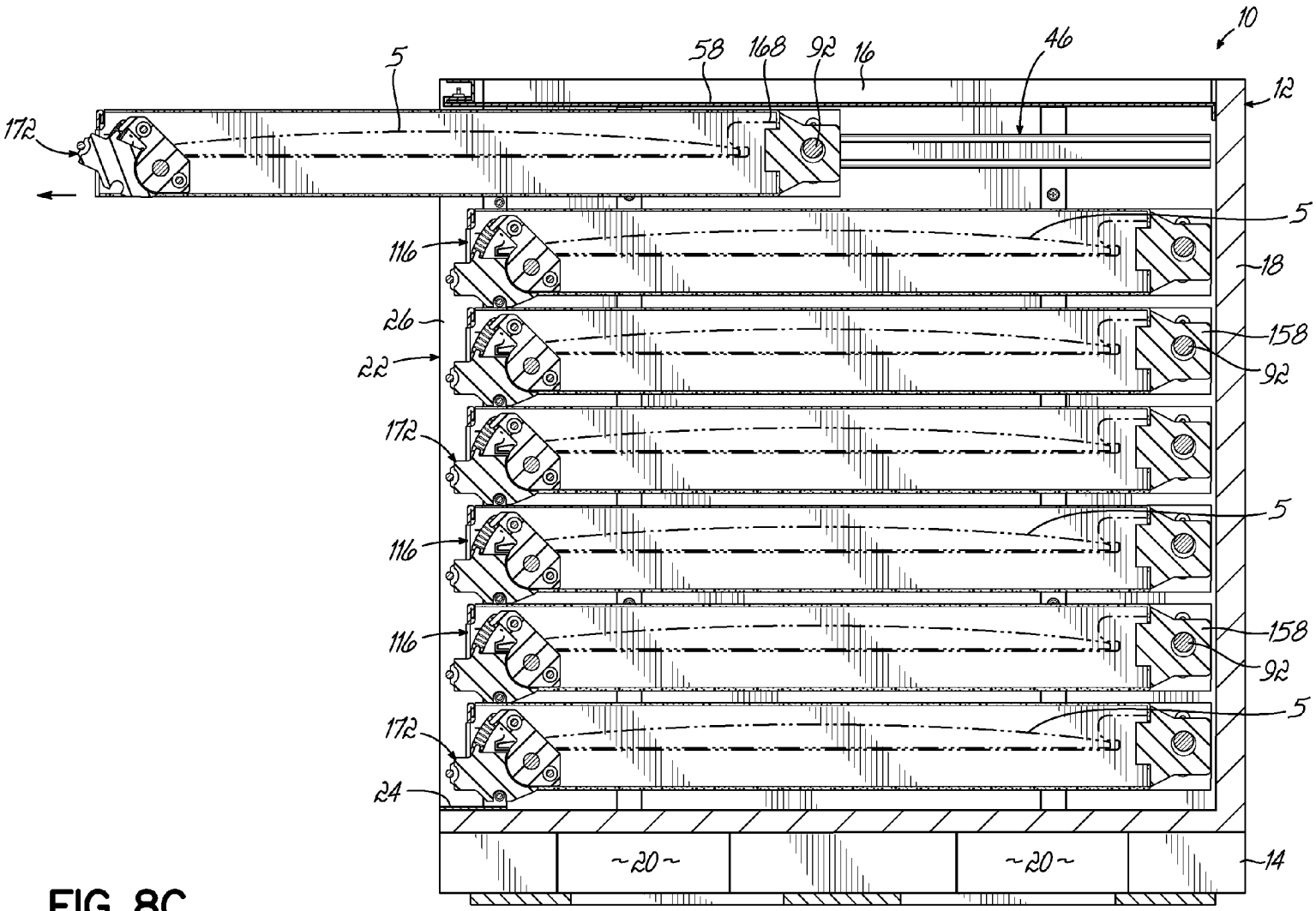
FIG. 8C is a side elevational view of the container of FIG. 8A, showing the top drawer being pulled to an open position.

As shown in FIG. 1, a cover 58 is secured to the rear wall 18 with fasteners 60 and extends forwardly. The cover 58 has a plurality of cut-outs 62 to allow access to fasteners 60 for removal of the cover 58 for repair/replacement. As best shown in FIG. 8B, the top channel 28 of front frame 22 is generally U-shaped in cross-section, including a top 64, bottom 66 and side 68. A front edge 70 of the cover 58 is passed around the bottom 66 of the top channel 28 of front frame 22 and secured thereto with fasteners 72 (only one being shown in FIG. 8B). As shown in FIG. 2A, the cover 58 is bent and extends downwardly to create side flaps 74 (only one being shown). The cover 58 is typically made of a flexible material, but may be made of a rigid or semi-rigid material.

The container 10 is used to store products 5 (shown in phantom in FIGS. 8A, 8C, 8D and 8E) during shipment. Once emptied, the container 10 may be shipped back to a supplier to be reloaded and shipped again full of products. Although one configuration of product 5 is illustrated and described herein, the present invention may be used to store and ship other configurations of product not shown or described. This document is not intended to limit the type of product being shipped or stored.

As best shown in FIGS. 2 and 3, container 10 further comprises a plurality of generally vertically oriented spaced straps 76 secured to each of the side walls 16 with fasteners 78 (only one set of straps 76 being shown). Although the drawings show two straps 76 secured to each side of the container, any number of vertically oriented straps may be secured to each side of the container. The straps 76 may be made of metal or any other desired material.

As shown in FIGS. 2 and 3, a plurality of generally horizontally oriented tracks 46 are secured to the straps 76 in any desired manner, such as welding, for example. The tracks 46 are vertically spaced apart from each other at different levels. The tracks 46 are fixed in stationary positions in corresponding pairs at the same vertical levels as disclosed in U.S. Pat. No. 9,016,507. Although FIGS. 2 and 3 disclose seven different levels or layers of tracks 46 (only one side being shown) the container may have any number of different levels or layers of tracks 46.

Figure 3B:
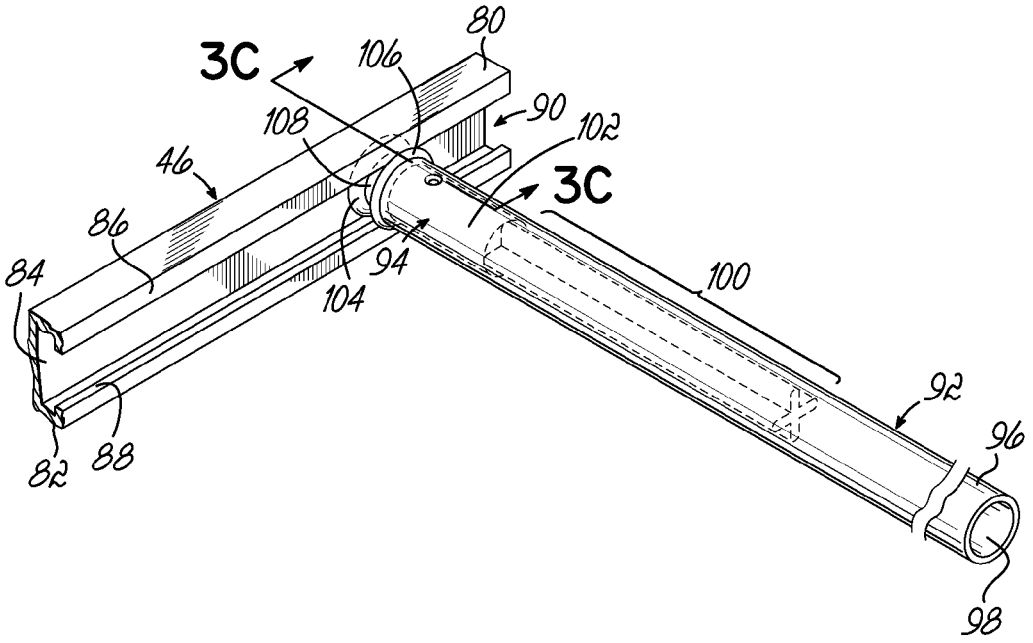
FIG. 3B is an enlarged perspective view of the encircled area 3B of FIG. 3.

As best shown in FIG. 3B, each track 46 has an upper wall 80, a lower wall 82 joined to the upper wall 80 by a side wall 84, and an upper lip 86 extending downwardly from the upper wall 80 and a lower lip 88 extending upwardly from the lower wall 82 defining an interior 90 of the track 46. Thus, each track 46 is generally C-shaped in cross-section. As disclosed in U.S. Pat. Nos. 9,004,307 and 9,010,563, each of which is fully incorporated by reference herein, each track 46 may have an opening or cut-out (not shown) formed therein covered by a cap (not shown) for removing or replacing damaged or worn drawer supports 92.

Referring to FIG. 1, container 10 further comprises a plurality of drawer supports 92 extending between opposed tracks 46 at the same level on opposed sides 16 of the container 10. As disclosed in U.S. Pat. Nos. 9,004,307 and 9,010,563, each drawer support 92 includes a pair of end members 94 and a tubular support 96 having a hollow interior 98 extending therebetween. The end members 94 are preferably made of injection molded plastic, such as nylon, but may be made of any other material. The middle member or tubular support 96 is preferably made of metal, but may be made of other suitable material, such as plastic.

As shown in FIG. 3B, each end member 94 preferably has a first portion 100 having an X-shaped cross-sectional configuration and a second portion 102 having a circular cross-sectional configuration. Although one configuration of end member 94 is illustrated, any type or configuration of end member may be used with the present invention. In this embodiment, each end member 94 has a pair of heads 104, 106 at the end of the end member 94. Head 104 is furthest from the first portion 100 of the end member 94, and head 106 is spaced inwardly from head 104. The heads 104, 106 are spaced from one another to define a groove 108 therebetween which receives and retains the lips 86, 88 of the stationary tracks 46. As shown in FIG. 3B, head 104 is located inside the interior 90 of tracks 46, and head 106 is located outside the interior 90 of stationary tracks 46. Head 104 keeps the end member 94 engaged with the track 46, while head 106 keeps the tubular support 96 out of the interior 90 of the track 46, thereby ensuring that the end members 94 may move smoothly along the stationary tracks. Although one configuration of drawer support 92 is illustrated, the present invention may be used with any type or configuration of drawer support for supporting a rear portion of a drawer so the drawer may slide or move inside the container.

Figure 3C:
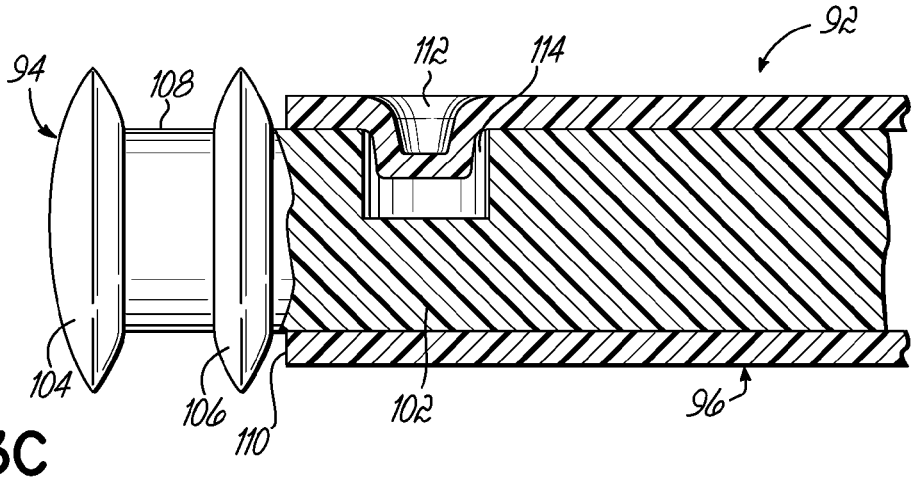
FIG. 3C is a cross-sectional view taken along the line 3C-3C of FIG. 3B.

As shown in FIG. 3C, each end of tubular support 96 fits over at least one portion 100 of an end member 94. An end surface 110 of tubular support 96 abuts head 106 of end member 94. Each end member 94 of each drawer support 92 is adapted to engage and move along one of the tracks. The end members 94 preferably slide along the length or width of the tracks; however, different end members may rotate, rather than slide, along the tracks. Although one configuration of track and end member is shown and described, other types of end members and tracks may be used if desired.

As best shown in FIG. 3C, drawer support 92 includes a pair of end members 94 (only one being shown in FIG. 3C). Each end member 94 has an opening 114 formed in a second portion 102 therein. Each drawer support 92 further includes a tubular support 96 having a hollow interior 98 extending therebetween. The tubular support 96 is preferably made of metal, but may be made of any suitable material, such as plastic. As shown in FIG. 3C, each end of tubular support 96 fits over at least one portion 100 of an end member 94. An end surface 110 of tubular support 96 abuts head 106 of end member 94. As shown in FIG. 3C, tubular support 96 has two detents 112 therethrough (one at each end) in which the material of the tubular support is pressed downwardly into the opening 114. This attachment between each of the two end members 94 and the tubular support 96 enables some movement therebetween. Such interaction between the end members 94 and tubular support 96 allows for a tolerance of approximately one-quarter inch on each side. The detents 112 prevent separation of the tubular support 96 from the end members 94 while allowing some movement therebetween as the detents 112 move within the openings 114 formed in the end members 94.

Figure 4:
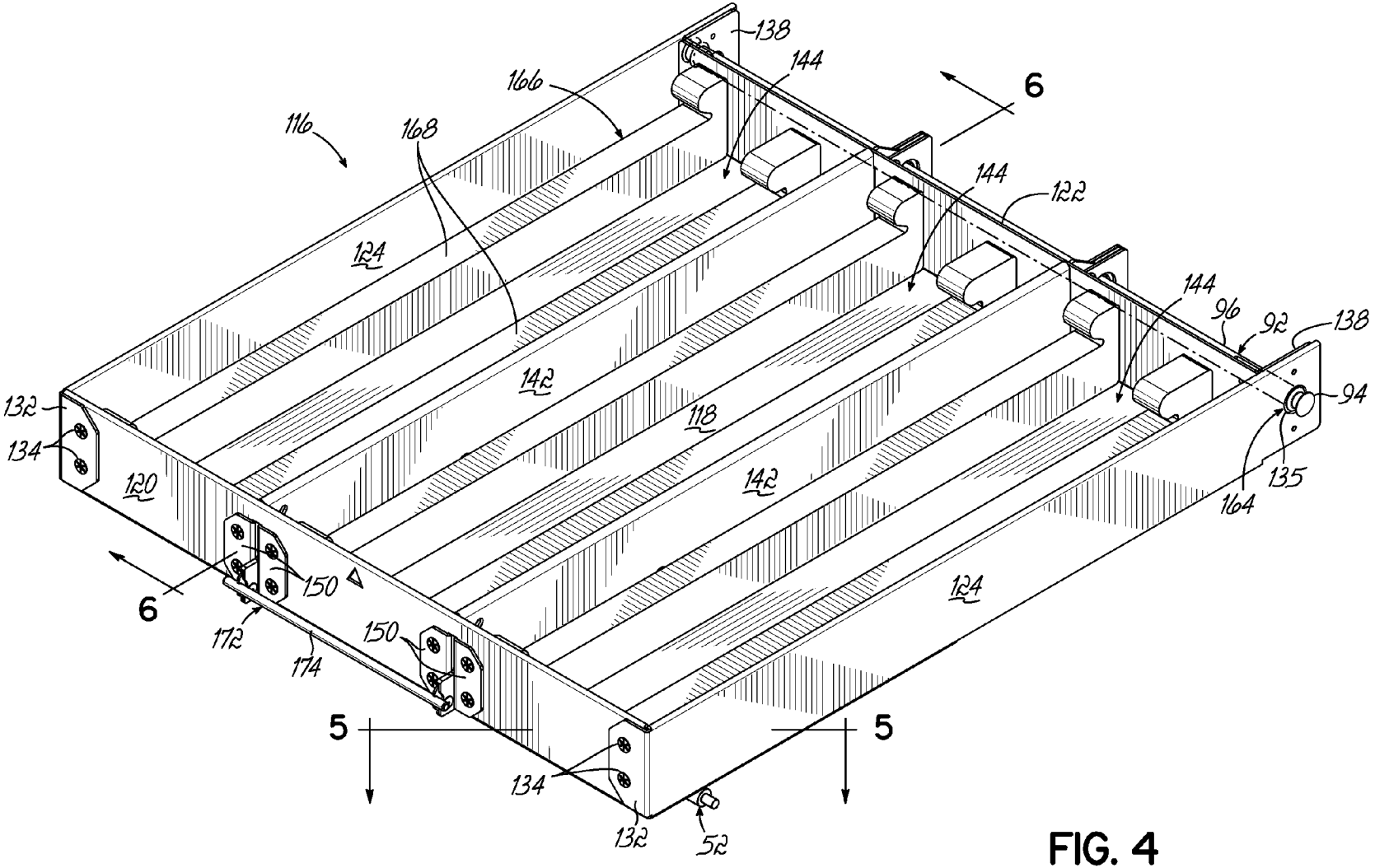
FIG. 4 is a perspective view showing one of the drawers of the container of FIG. 1.
Figure 4A:
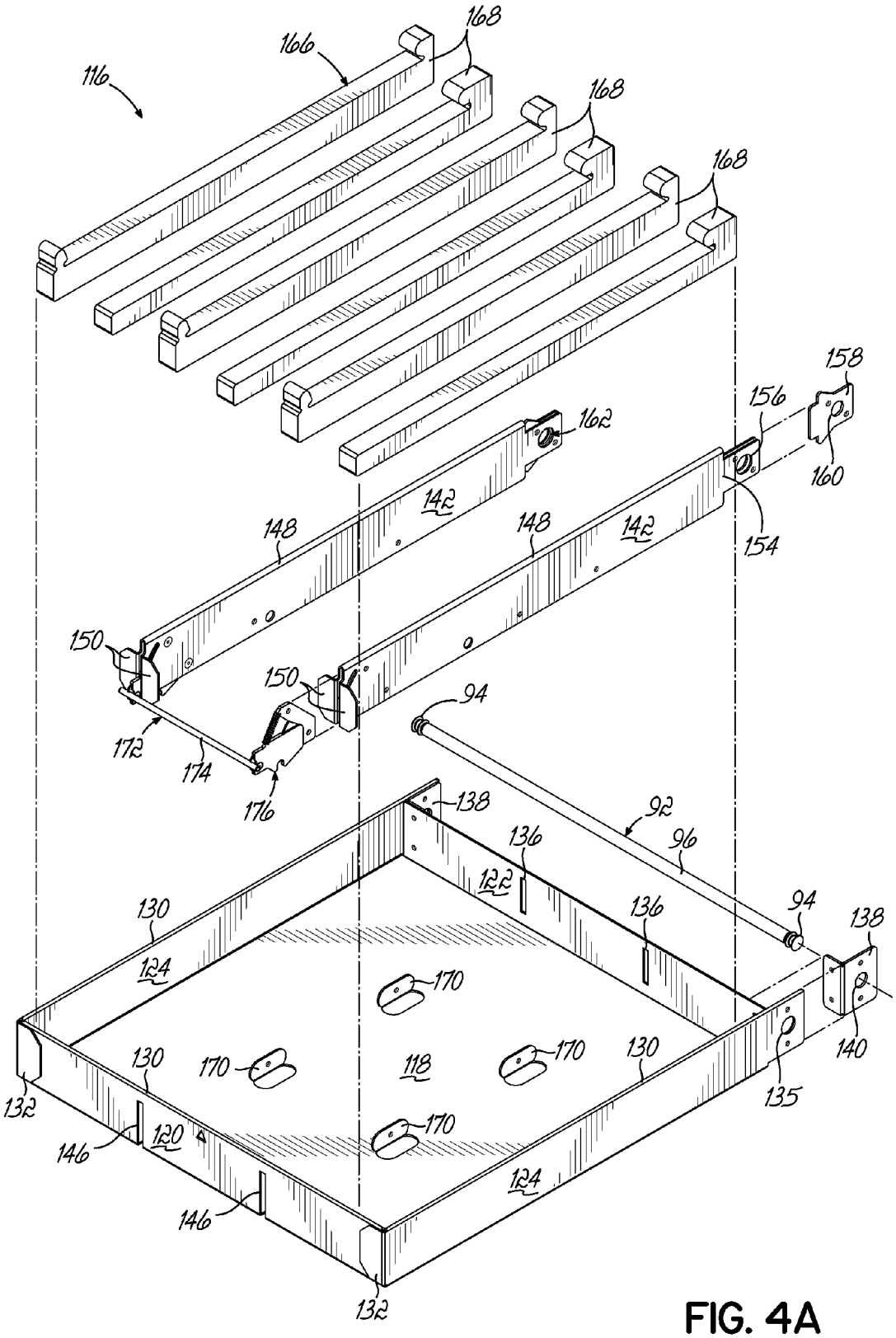
FIG. 4A is a partially disassembled view of the drawer of FIG. 4.

The container 10 further comprises a plurality of drawers or trays 116. As best shown in FIGS. 4 and 4A, each drawer 116 has a floor 118, a front wall 120, a rear wall 122 and two side walls 124 all made by folding a blank piece of corrugated plastic. However, the blank need not be corrugated plastic; the blank may be any desired material, including known types of plastic. As seen in FIG. 5, the corrugated plastic of the floor 118 is turned upwardly to create the walls 120, 122 and 124. As shown in FIGS. 4 and 5, the rear wall 122 is single ply and the front 120 and side walls 124 are double ply. As shown in FIG. 5, the corrugated plastic material is bent downwardly and extends downwardly inside the front and side walls 120 and 124. Thus, each of the front and side walls 120, 124, respectively, is two-ply with an inner ply 126 being shorter than an outer ply 128. Each of the front and side walls 120, 124 has a rounded top or upper edge 130 to minimize injury to an operator during insertion or removal of products 5 from inside the drawer. As shown in FIG. 4, a front portion 132 of each side wall 124 is turned inwardly over the front of the front wall 120 and welded with welds 134 to the front wall 120. As seen in FIG. 4A, each side wall 124 also has an opening 135 at the rear thereof (only one being shown) sized to receive one of the drawer supports 92. The rear wall 122 has two spaced slots 136 and the front wall 120 has two spaced slots 146.

As shown in FIG. 4A, each drawer 116 further comprises two end brackets 138. Each end bracket 138 is attached to one of the side walls 124 inside the side wall 124 as shown in FIG. 4A and has an opening 140 through the end bracket 138 sized to receive one of the drawer supports 92. The opening 140 aligns with the opening 135 of the side wall 124 to which the end bracket 138 is attached to create an end opening 164. See FIG. 4.

As shown in FIG. 4A, each drawer 116 further comprises a pair of dividers 142 separating the interior of the drawer 116 into three compartments 144. Although drawer 116 is shown as having two dividers 142, any of the drawers of a container may have any number of dividers and any number of compartments. The drawers of a container may have different numbers of dividers and compartments of different sizes; the drawers of a container need not be identical.

Figure 6:
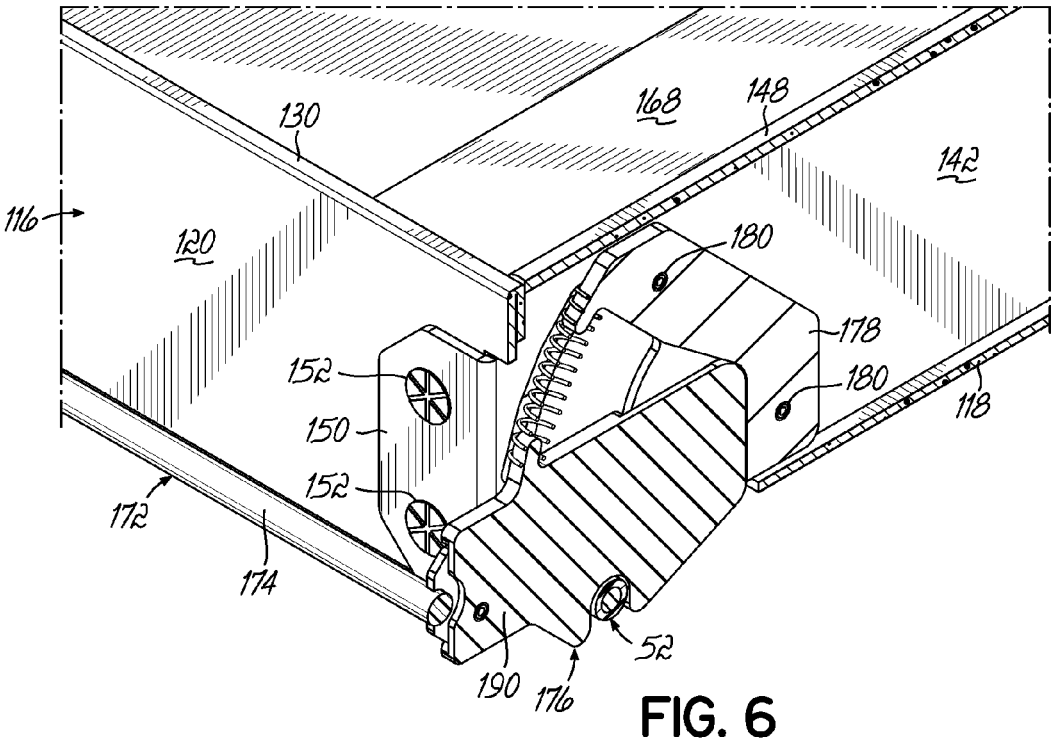
FIG. 6 is a cross-sectional view taken along the line 6-6 of FIG. 4.

As shown in FIG. 4A, each divider 142 is generally two-ply with a rounded upper edge 148. Each ply has an outwardly extending tab 150, which is secured to the front wall 120 with welds 152, as shown in FIG. 6, after the tabs 150 of one of the dividers 142 are passed through one of the front slots 146. As shown in FIG. 4A, each divider 142 has a two-ply rear portion 154 having an opening 156 which extends through one of the rear slots 136. A stabilizer 158 having an opening 160 is secured to the rear portion 154 of the divider 142 between the plies, the opening 160 being aligned with the openings 156 of each ply. Thus, after being fully assembled, each divider 142 has a combined opening 162 sized to receive one of the drawer supports 92. When fully assembled, each drawer 116 has one drawer support 92 which extends through the combined opening 162 of each divider 142 and the end opening 164 of each side wall 124 behind the rear wall 122 of the drawer. The drawer support 92 has end members 94, as described above, which engage and move along opposed tracks 46 at the same level to guide movement of the drawer 46.

As shown in FIG. 4A, the floor 118 of the drawer 116 has four tabs 170 formed from the plastic material of the floor 118. Two aligned tabs 170 are secured to one of the dividers 142 to secure the divider 142 in a generally vertical position inside the drawer 116 parallel the drawer side walls 124.

As shown in FIGS. 4 and 4A, each drawer 116 has dunnage 166 in the form of two foam blocks 168 per compartment 144. The dunnage 166 is not intended to be limited to the size or shape shown or the number of pieces shown. Different configurations of dunnage may be secured inside one or more of the drawers 116 to cushion the products being shipped during shipment.

Figure 6A:
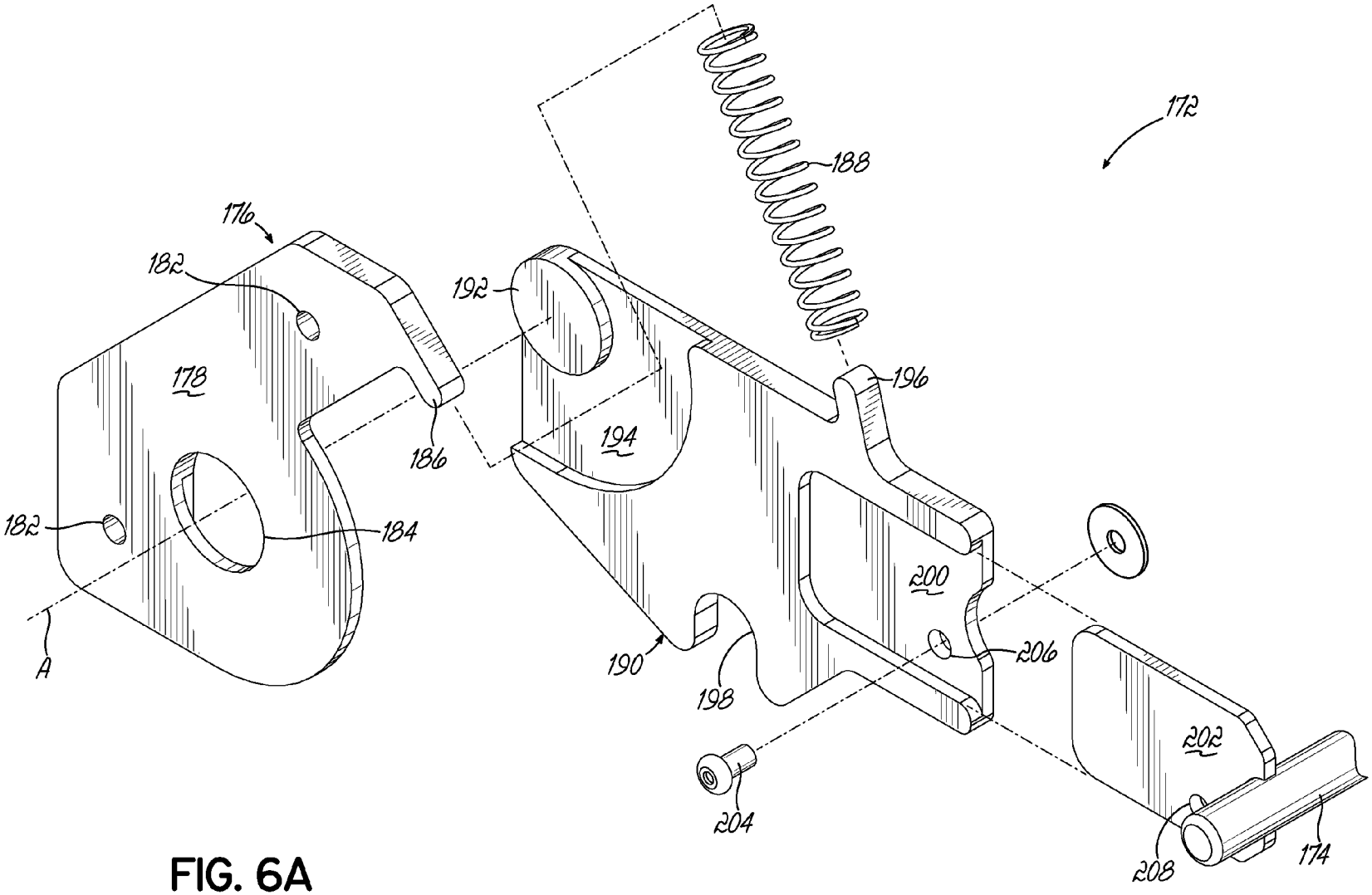
FIG. 6A is a disassembled perspective view of a portion of the latch assembly of a drawer.

Each drawer 116 further comprises a latch assembly 172, illustrated in detail in FIGS. 6 and 6A. The latch assembly 172 comprises a handle 174 and two locking mechanisms 176, one on each side of handle 174. Each locking mechanism 176 comprises a stationary piece 178 secured to one of the plies of a divider 142 with two fasteners 180. Each fastener 180 passes through an opening 182 in stationary piece 178, as shown in FIG. 6A. Stationary piece 178 has a central opening 184 which aligns with rotational axis A, shown in FIG. 6A, and a finger 186 around which one end of a spring 188 is placed.

The latch assembly 172 further comprises a movable piece 190 having a hub 192 received inside central opening 184 of stationary piece 178. A recess 194 is located around a portion of hub 192 of movable piece 190. The movable piece 190 of latch assembly 172 also has a finger 196 around which the other end of spring 188 is located. As shown in FIG. 6A, the movable piece 190 of latch assembly 172 also has a retainer 198 in which resides the roller assembly 52 when the drawer 116 is in its locked and closed position. Lastly, the movable piece 190 of latch assembly 172 also has a cavity 200 in which resides a handle plate 202, each handle plate 202 (only one being shown) being welded or fixedly secured to the handle 174. The handle plate 202 is secured with a rivet 204 inside the cavity 200 of the movable piece 190 of latch assembly 172, the rivet or fastener 204 passing through an opening 206 in the movable piece 190 of latch assembly 172 and through an opening 208 in the handle plate 202.

Figure 7A:
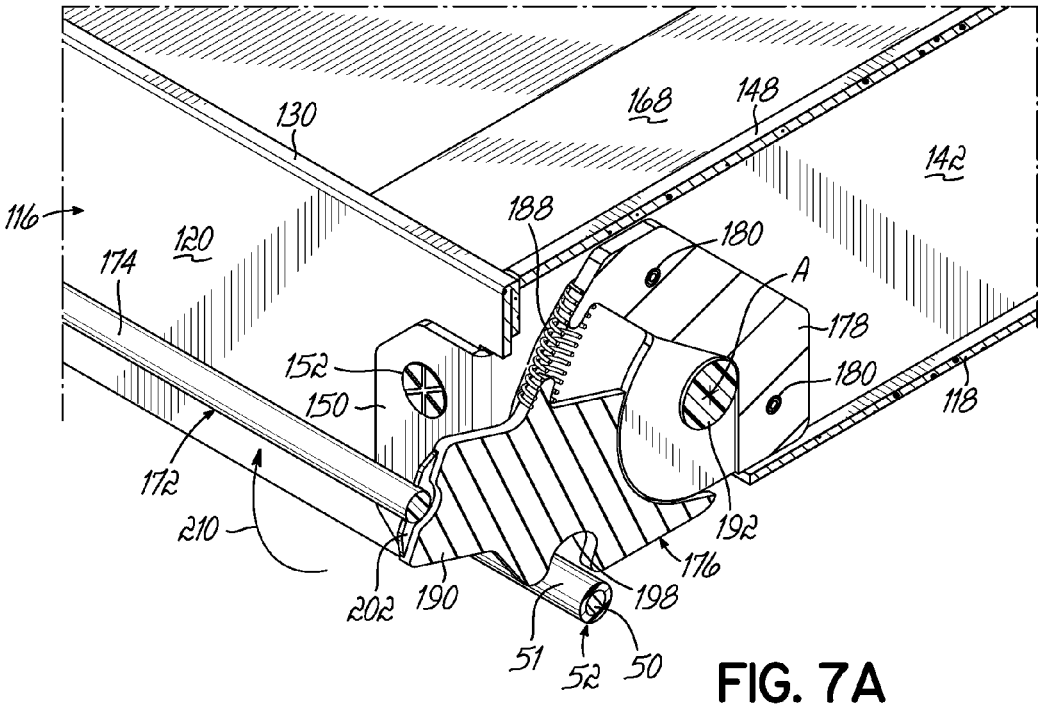
FIG. 7A is a perspective view of the latch assembly of one of the drawers being raised to open the drawer.
Figure 7B:
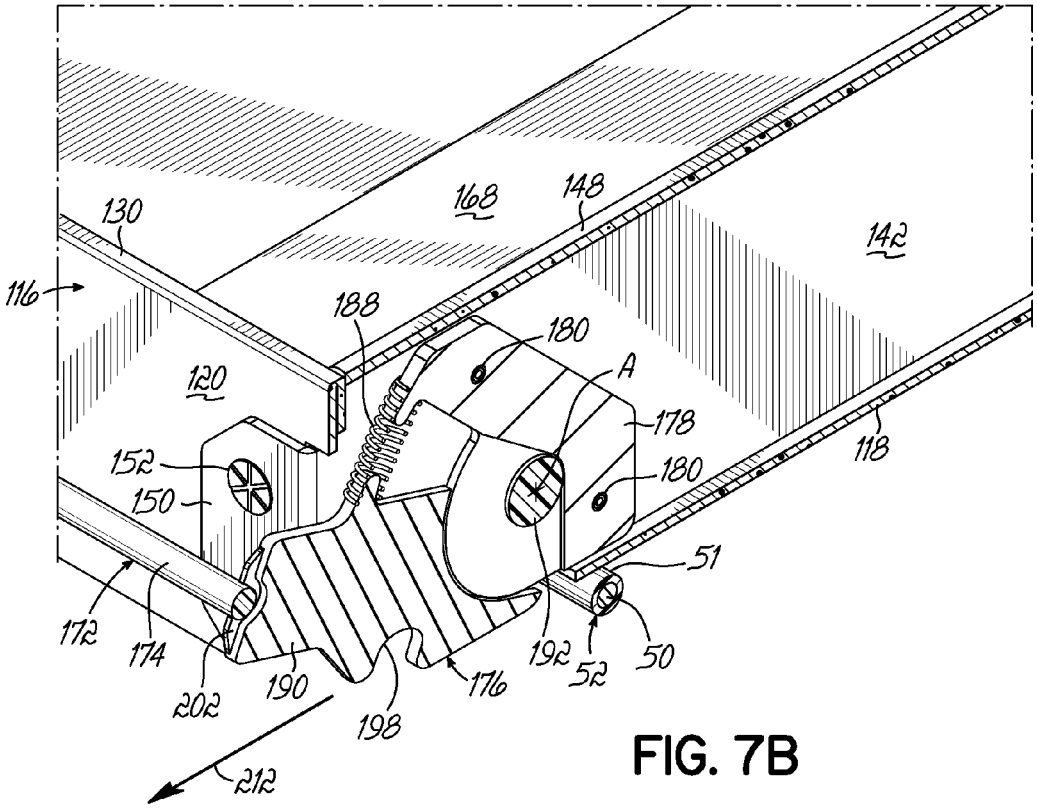
FIG. 7B is a perspective view of the drawer of FIG. 7A being pulled out to an extended or open position.

In operation, when the handle 174 is raised in the direction of arrow 210 shown in FIG. 7A, the movable piece 190 of latch assembly 172 is rotated about axis A. Rotational movement of the movable piece 190 of latch assembly 172 causes the spring 188 to compress and the retainer 198 of the movable piece 190 of latch assembly 172 to raise upwardly, such that the retainer 198 no longer surrounds rod 50 of roller assembly 52. The drawer 116 may then be opened in the direction of arrow 212 without interference from the rod 50 of roller assembly 52. In fact, movement of the drawer 116 is assisted by the roller 51 of the roller assembly 52.

As best shown in FIG. 3, each side of container 10 has a stop 214 (only one being shown) adapted to pass through openings 216 in the tracks 46. The stop 214 has a handle 218 at the top thereof. The function of the stops 214 is to prevent one of the drawers 116 from being pulled out of the container 10. The stops 214 extend through the interior 90 of tracks 46 and prevent the end members 94 of the drawer support 92 from being pulled out the front end of the tracks 46. Although one configuration of stop 214 is illustrated, the stops may assume other configurations.

FIGS. 8A-8E illustrate the process of opening one of the drawers 116 of the container 10 and unloading products 5 from the drawer 116. The process of loading products 5 into the container 10 is the opposite. Although the process of opening only one of the drawers 116 of the container 10 and unloading products 5 from the drawer 116 is illustrated, the process is the same for each drawer 116.

Operationally, the method of unloading products 5 from one of the drawers 116 of the container 10 comprises the following steps. For purposes of this explanation, the operator or person doing the unloading ("the unloader") is located proximate the front of the container. First, as shown in FIG. 8A, the unloader pulls handle 174 upwardly, causing the movable pieces 190 of both locking assemblies 176 to pivot about axis A in a clockwise direction, as shown in FIG. 8A. With the handle 174 in its raised position, the rod 50 of the roller assembly 52 no longer keeps the drawer 116 in its locked and closed position, so the unloader may pull the drawer 116 outwardly to an extended position shown in FIG. 8C. As the drawer 116 moves outwardly, the drawer support 92 moves along tracks 46, and the drawer 116 passes over the rotational roller assembly 52.

Figure 8D:
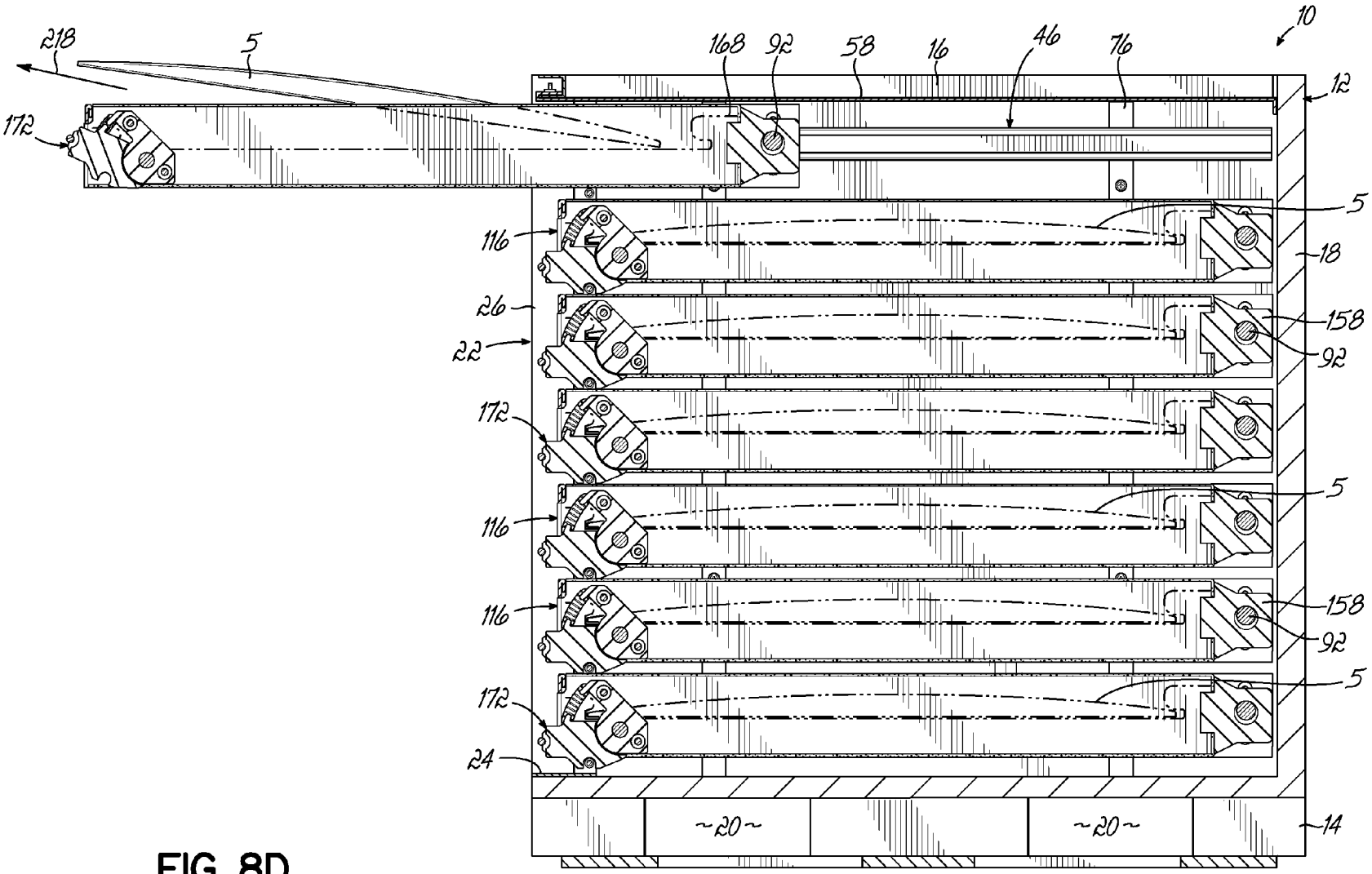
FIG. 8D is a side elevational view of the container of FIG. 8A, showing a product being removed from the top drawer while the top drawer is open.
Figure 8E:
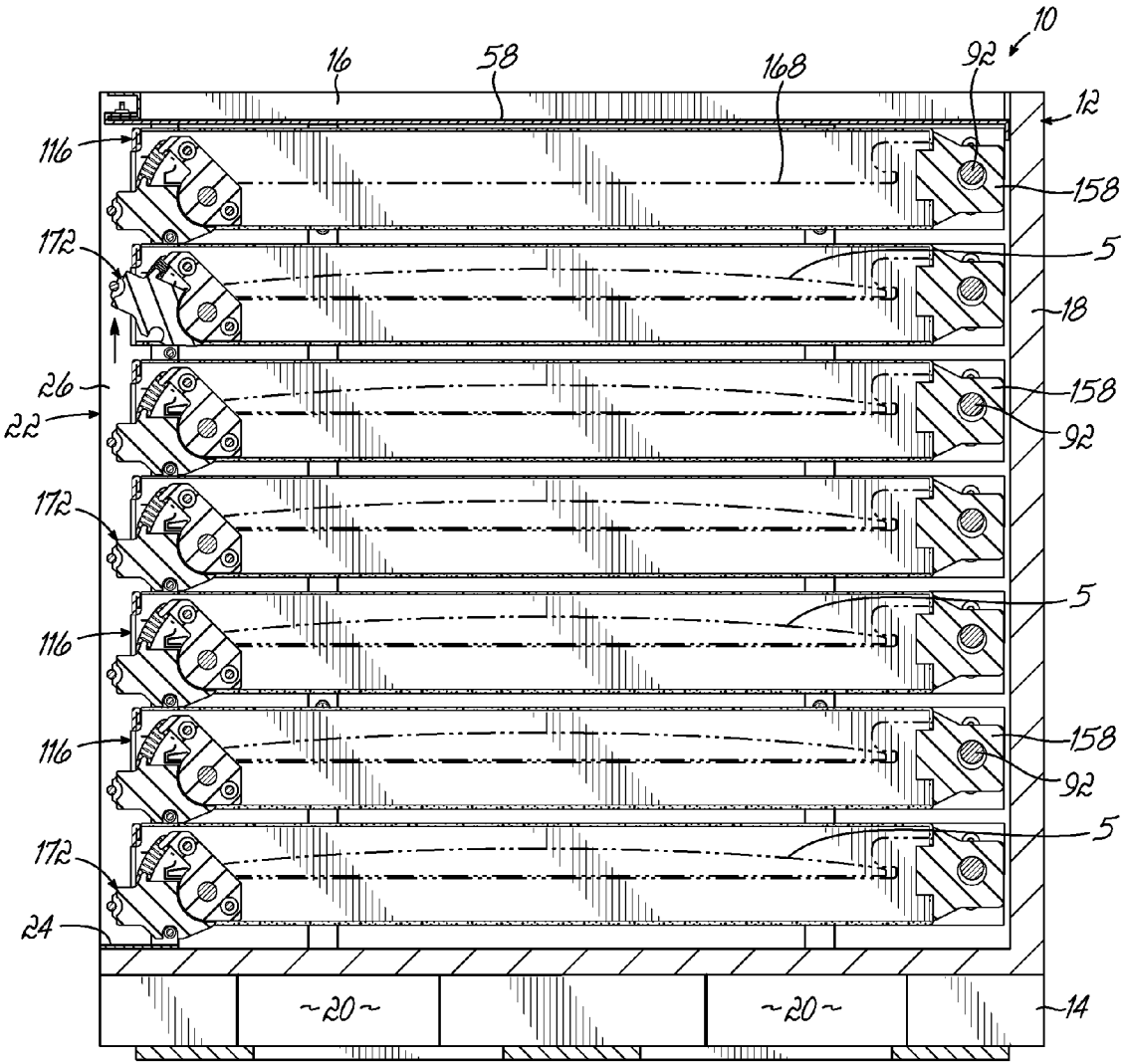
FIG. 8E is a side elevational view of the container of FIG. 8A, showing the top drawer in its closed position after product has been removed from inside the top drawer.

As shown in FIG. 8D, with the drawer in its extended position, the end members 94 of the drawer support 92 abuts the stops 214 extending through the tracks 46. A product 5 or multiple products 5 may be lifted by an operator out of the dunnage inside the drawer 116 in the direction of arrow 218. Once all the products 5 have been removed from inside the drawer 116, the unloader may then move the drawer 116 to its closed and locked position shown in FIG. 8E.

The unloader may then open a second, lower drawer 116 supported by the second level of tracks 46. This process continues one level at a time until all drawers have been emptied of products 5.

In any of the embodiments shown or described herein, each level or layer of dunnage inside the drawer may comprise a single or multiple pieces of cushioning material used to protect products from damage during shipment. This document is not intended to limit the material of the dunnage.

While various embodiments of the present invention have been illustrated and described in considerable detail, it is not the intention of the applicant to restrict or in any way limit the scope of the claims to such detail. Additional advantages and modifications will readily appear to those skilled in the art. The invention in its broader aspect is, therefore, not limited to the specific details, representative system, apparatus, and method, and illustrative example shown and described. Accordingly, departures may be made from such details without departing from the spirit or scope of the applicant's general inventive concept.

What is claimed is:

1. A container for holding product therein during shipment, the container comprising:

a base and two sides;

sets of tracks supported by the container sides;

a plurality of roller assemblies, each of the roller assemblies comprising a stationary rod extending between the sides of the container and a roller surrounding the rod, each of the roller assemblies being below one of the sets of tracks;

a plurality of drawers extending between tracks on opposed sides of the container, each of the drawers having a floor, a front wall, a rear wall and side walls, the drawer being movable between open and closed positions and being supported by one of the roller assemblies, a plurality of drawer supports, each of the drawer supports corresponding to one of the drawers and extending through both side walls of the corresponding drawer and having end members to guide movement of the drawer, the end members of the drawer support being movable along the tracks during movement of the drawer, wherein each of the drawers has a latch assembly which maintains the drawer in its closed position, such that the drawer may only be moved to its open position by moving the latch assembly to disengage the latch assembly from one of the roller assemblies.

2. The container of claim 1 wherein the latch assembly has an integral handle.

3. The container of claim 1 wherein the latch assembly includes two locking mechanisms which engage one of the roller assemblies to hold the drawer in its closed position.

4. The container of claim 1 wherein at least one of the drawers is made of plastic.

5. The container of claim 1 further comprising stops to prevent the drawers from falling out of the container.

6. The container of claim 1 further comprising dunnage inside at least one of the drawers.

7. The container of claim 6 wherein the dunnage comprises at least one piece of foam.

8. A container for holding product therein during shipment, the container comprising:

a base and at least two sides;

sets of tracks supported by the container sides;

a plurality of roller assemblies, each of the roller assemblies comprising a rod extending between the sides of the container and a roller surrounding the rod, each of the roller assemblies being below one of the sets of tracks;

a plurality of drawers, each of the drawers having a floor, a front wall, a rear wall and side walls, the drawer being movable between open and closed positions;

a plurality of drawer supports, each of the drawer supports being secured to one of the drawers, being behind the rear wall of the drawer and extending through the side walls of the drawer, each of the drawer supports comprising a pair of end members and a tubular support extending between the end members to guide movement of the drawer, wherein each of the drawers has a latch assembly which biases the drawer in its closed position and the drawer may only be moved to its open position by moving a handle of the latch assembly, thereby causing the latch assembly to disengage from one of the roller assemblies.

9. The container of claim 8 wherein portions of each of the drawer supports remain inside the tracks during movement of the drawer.

10. The container of claim 8 further comprising dunnage inside at least one of the drawers.

11. The container of claim 10 wherein the dunnage comprises at least one piece of foam.

12. The container of claim 8 wherein the container has at least one stop extending through multiple tracks on each side of the container to prevent the drawers from falling out of the container.

13. A container for holding product therein during shipment, the container comprising:

a base and at least two sides;

sets of tracks supported by the container sides, each of the tracks having upper and lower lips;

a plurality of roller assemblies, each of the roller assemblies comprising a rod extending between the sides of the container and a roller surrounding the rod;

a plurality of drawers, each of the drawers having a floor, a front wall, a rear wall and side walls, the drawer being movable between a closed position inside the container and an open position in which products may be inserted into or removed from inside the drawer, a plurality of drawer supports, each of the drawer supports extending through the side walls of one of the drawers, each of the drawer supports comprising a pair of end members and a tubular support extending between the end members, each of the end members having a groove which receives and retains the upper and lower lips of one of the tracks of one of the sets of tracks to guide movement of the drawer, wherein each of the drawers has a spring-loaded latch assembly which maintains the drawer in its closed position until the latch assembly is moved to allow the drawer to disengage from one of the roller assemblies and be moved to its open position.

14. The container of claim 13 wherein each of the roller assemblies is removable from the container.

15. The container of claim 13 wherein at least one of the drawers is made of plastic.

16. The container of claim 13 wherein at least one of the drawers is made of corrugated plastic.

17. The container of claim 13 further comprising dunnage inside at least one of the drawers.

18. The container of claim 17 wherein the dunnage comprises at least one piece of foam.

19. The container of claim 17 wherein at least one drawer has at least one divider separating the interior of the drawer into compartments.

20. The container of claim 19 further comprising dunnage inside at least one of the compartments.

* * * * *